US005360127A

United States Patent [19]

Barriac et al.

[11] Patent Number: 5,360,127

[45] Date of Patent: Nov. 1, 1994

[54] NON-REMOVABLE CONTAINER CLOSURE

[75] Inventors: Jacques J. Barriac, Claremont; Ron E. Harriman, Montebello, both of Calif.

[73] Assignee: Calmar Inc., City of Industry, Calif.

[21] Appl. No.: 197,804

[22] Filed: Feb. 17, 1994

[51] Int. Cl.[5] ..... B65D 49/00

[52] U.S. Cl. ..... 215/263; 215/274; 215/276; 215/330

[58] Field of Search ..... 215/263, 274, 276, 330, 215/339; 220/86.4

[56] References Cited

U.S. PATENT DOCUMENTS

| | | | |
|---|---|---|---|
| 3,977,557 | 8/1976 | Hazard | 215/274 |
| 4,345,691 | 8/1982 | Burke . | |
| 4,346,821 | 8/1982 | Wesner et al. | 215/274 X |
| 4,366,921 | 1/1983 | Kirk, Jr. | 215/274 X |
| 4,781,311 | 11/1988 | Dunning et al. | 215/330 X |
| 5,143,237 | 9/1992 | Lindsey . | |
| 5,238,152 | 8/1993 | Maas et al. | 215/274 X |

*Primary Examiner*—Allan N. Shoap
*Assistant Examiner*—Vanessa Caretto
*Attorney, Agent, or Firm*—Watson, Cole, Grindle & Watson

[57] ABSTRACT

A non-removable closure assembly for connecting a manually actuated liquid dispenser to a container includes a closure cap having internal threads for mating engagement with similar threads on the outside of the container neck finish, both the cap and the neck finish having mutually engageable ratchet teeth locking the closure onto the container. The teeth inside the cap each have a trailing face extending radially at an upper end thereof and lying in a plane sloping toward the thread loosening direction of the cap at an angle greater than or equal to 1° relative to the central axis of the cap for creating a camming action between the closure teeth and the neck finish teeth tending to cam the closure down on the container in response to closure rotation in the loosening direction.

4 Claims, 1 Drawing Sheet

NON-REMOVABLE CONTAINER CLOSURE

BACKGROUND OF THE INVENTION

This invention relates generally to a closure for connecting a manually actuated liquid dispenser to a container upon threading the closure to the container neck finish, mutually engaging ratchet teeth on the closure and neck finish serving to positively lock the closure in place. More particularly, the ratchet teeth inside the closure are specifically designed to force the closure down on the container upon attempts to unscrew the closure.

Many manually actuated dispensers of the pump actuated type, for example, are thread mounted on plastic containers for dispensing of a wide variety of liquid products. Many products such as paint removers, oven cleaners, insecticides, etc. could be harmful if improperly used.

Non-removable closures for connecting the dispensers to the container have been devised utilizing a ratchet system for locking the closure to the container neck finish to prevent removal of the dispenser upon unscrewing the closure.

U.S. Pat. No. 4,345,691 discloses a child resistant bottle closure providing ratchet teeth inside the closure in engagement with ratchet teeth on the outside of the container neck finish to prevent the cap and pump from being removed from the container upon unscrewing the closure. The closure ratchet teeth and the neck finish ratchet teeth have mutually engagable trailing faces which extend radially and lie in planes containing the central axis of the closure. And, the ratchet teeth inside the closure are mutually spaced apart.

Such a ratchet system and others of the prior art can, however, fail upon application of sufficient torque on the cap in the unscrewing direction as caused by plastic deformation between the engaged ratchet teeth faces thereby decreasing the retention capability of the ratchet system.

SUMMARY OF THE INVENTION

It is therefore an object of the present invention to provide a non-removable closure assembly for connecting a manually actuated liquid dispenser to a container which avoids the aforementioned drawbacks of the prior art for a threaded closure having ratchet teeth locked in engagement with ratchet teeth on the outside of the neck finish.

According to the invention, the ratchet teeth inside the closure are specifically configured to increase the retention capability when engaged with the ratchet teeth on the outside of the container neck finish. The closure ratchet teeth each have a trailing face extending radially at an upper end thereof and lying in a plane sloping from the upper end in the closure unthreading direction at an angle of 1° or more relative to the central axis of the closure for creating a camming action between the closure teeth and the neck finish teeth tending to cam the closure down on the container in response to cap rotation in the closure removal direction. The net result is an increase in the retention capability of the ratchet system.

Other objects, advantages, and novel features of the invention will become more apparent from the following detailed description of the invention when taken in conjunction with the accompanying drawings.

DETAILED DESCRIPTION OF THE INVENTION

Figure 1:
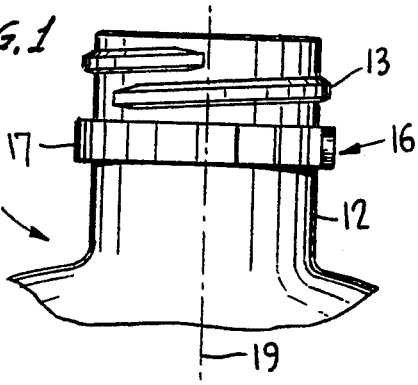
FIG. 1 is a side elevational view of a container, partly broken away, showing the container neck finish with which the closure according to the invention engages.
Figure 2:
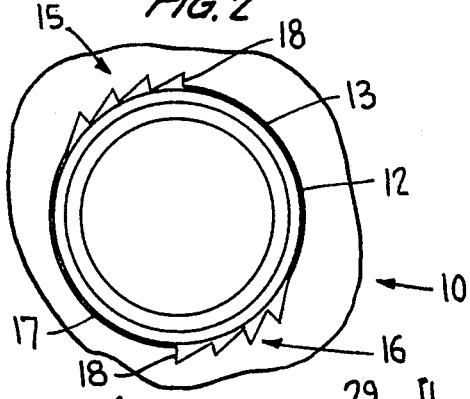
FIG. 2 is a top plan view of the container of FIG. 1.
Figure 4:
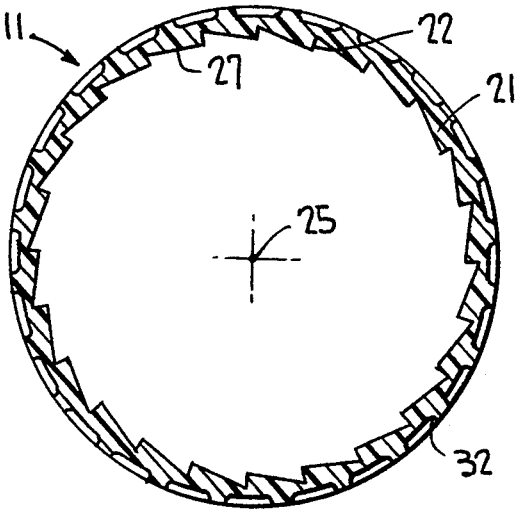
FIG. 4 is a sectional view of the FIG. 3 closure taken substantially along the line 4—4 of FIG. 3.
Figure 3:
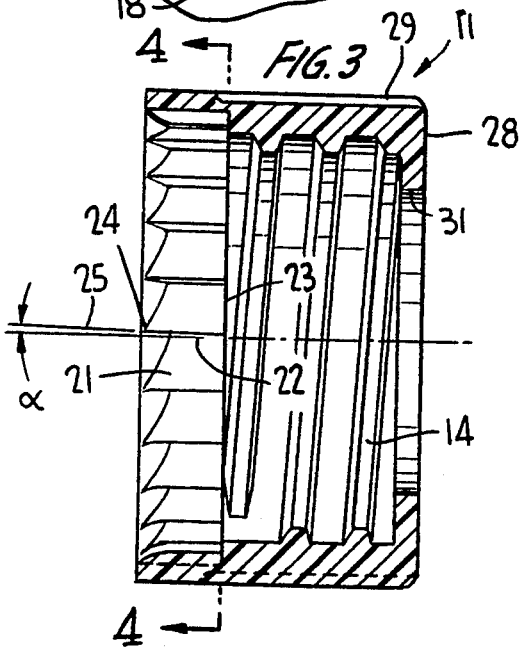
FIG. 3 is a vertical sectional view of the closure according to the invention, at an enlarged scale.

Turning now to the drawings wherein like references characters refer to like and corresponding parts throughout the several views, container 10 of FIGS. 1 and 2 and closure cap 11 of FIGS. 3 and 4 are typically moulded of a plastic material such as a polyolefin which may for example be a high density polyethylene, polypropylene or the like.

Figure 5:
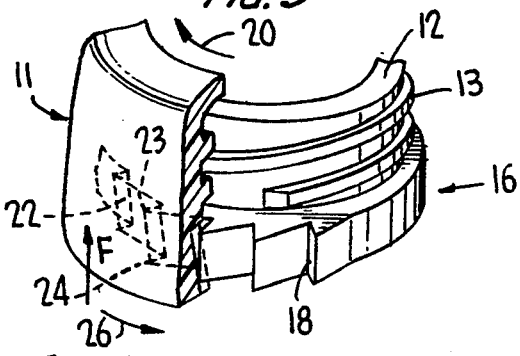
FIG. 5 is a perspective view of the closure of the invention threaded down and locked on the container neck finish, shown partly broken away.

The container has a cylindrical neck finish 12 with an external thread 13 for engagement with a like thread 14 on the inside of the closure cap upon cap rotation in a predetermined direction as shown by arrow 20 of FIG. 5. A series of ratchet teeth 15, 16 are provided beneath thread 13 on the bottle neck finish on a ridge 17. The two sets of ratchet teeth may be spaced 180° apart and each may include 4 ratchet teeth, although each set may have more or fewer ratchet teeth than illustrated, without departing from the invention.

The trailing face 18 of each ratchet tooth of each set 15, 16 extends radially and entirely lies in a plane containing the central axis 19 of the container and neck finish, as likewise shown in U.S. Pat. No. 4,345,691.

Inside the cap beneath thread 14 are provided a series of ratchet teeth 21 each having a trailing face 22 extending radially inwardly at upper end 23 of each tooth. In accordance with the invention, each trailing face 22 is sloped from its upper end 23 to its lower end 24 at an angle $\alpha$ equal to or greater than 1° relative to central axis 25 of the closure. The slope of each trailing face 22 from a direction toward the upper end 23 to its lower end 24 is in an unthreading or loosening direction of the closure on the neck finish, shown by arrow 26 in FIG. 5.

As seen in FIGS. 3 and 4, ratchet teeth 21 inside the closure are uniformally distributed, contiguous and each have a bevelled side face 27 terminating at an adjacent tooth. The included angle between faces 22 and 27 of adjacent teeth 21 is constant between upper and lower ends 23 and 24 of each tooth 21.

Figure 6:
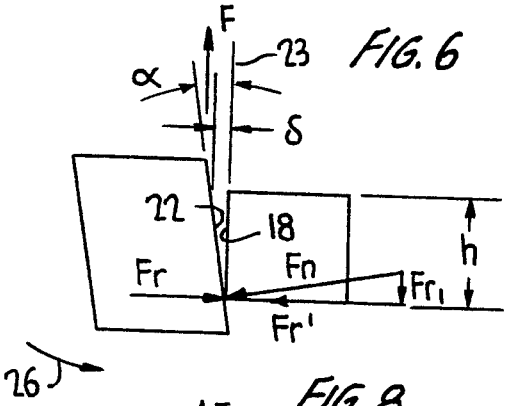
FIG. 6 is a schematic illustration, at an enlarged scale, of a pair of typical ratchet teeth faces in engagement when locked as shown in FIG. 5.

The angled ratchet face 22 of each closure tooth which engages the axial or straight face 18 of each container ratchet tooth results in a force vector component Fr1 (FIG. 6) which is opposite in direction to the force vector F created by the unthreading torque $\tau$ applied upon attempts to loosen the closure in the direction of arrow 26 of FIGS. 5 and 6. This resultant force Fr1 creates the tendency to force the closure down onto the container counteracting the plastic deformation that normally occurs when the engaged ratchet teeth are loaded by the unthreading torque.

With further reference to FIG. 6, $\delta$ represents the gap between the container ratchet tooth face 18 and the closure ratchet tooth face 22. h is the height of face 18. If $\delta > 0$ then $\alpha$ max is defined by $\delta$ and h:

$$\text{tangent } \alpha \text{ max} = \frac{\delta}{h}.$$

Should the angle of the closure teeth be larger than $\alpha$ max then the closure teeth could not engage the container ratchet teeth.

max is clearly defined by the container closure ratchet parameters (dimensions) such that the angle $\alpha$ should be in the range of $1° \leqq \alpha < \alpha$ max.

Figure 7:
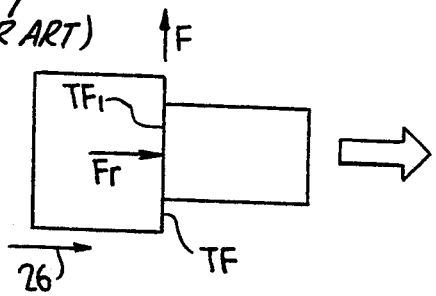
FIG. 7 (PRIOR ART)
FIG. 7 is a schematic illustration, at an enlarged scale, of a typical pair of ratchet teeth faces in engagement according to the prior art when a ratchet closure is locked down on the ratchet teeth of a container neck finish.
Figure 8:
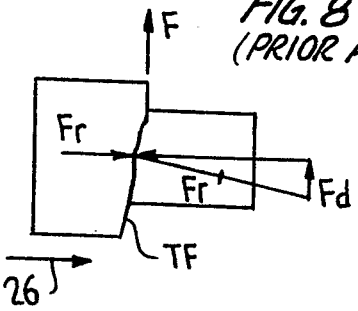
FIG. 8 (PRIOR ART)
FIG. 8 is a schematic illustration of the plastic deformation which occurs when applying an unthreading torque to the ratchet closure of the FIG. 7 prior art.

With reference to FIGS. 7 and 8, this plastic deformation occurs in the closure removal direction 26 at the engaged straight trailing faces TF and TF1 and increases the tendency toward removal by yielding a force vector component Fd which adds to the removal force F.

The counter angle of the closure ratchet teeth according to the invention negate this deformation force by producing immediately upon loading by the closure removal torque, the force vector component Fr1 in the opposite direction of removal. By creating a deformation loading opposite to that which occurs with the parallel ratchet faces TF, TF1 of FIG. 7, the inherent weakness of the plastic components (closure and container), i.e., plastic deformation, is negated. The net result is an increase in the retention capability of the ratchet system according to the invention, as most clearly illustrated in FIGS. 5 and 6.

The closure cap is cylindrical and has a top wall 28 and, a circular side wall 29, the top wall having an opening 31 for receiving and holding a manually actuated pump dispenser (not shown) as in any normal manner. Side wall 29 has a plurality of ribs or ridges 32 to enable the user to better grasp the closure for threading it onto the container.

From the foregoing it can be seen that a simple yet highly effective and unique redesign of the trailing faces of the closure cap ratchet teeth has been provided for camming the closure down on the container neck finish upon attempts to unthread or loosen the closure, thereby enhancing the non-removable capabilities of present closure container system.

Obviously, modifications and variations of the present invention are made possible in the light of the above teachings. It is therefore to be understood that within the scope of the appended claims the invention may be practiced otherwise than as specifically described.

What is claimed is:

1. A non-removable closure assembly for connecting a manually actuated liquid dispenser to a container, the assembly comprising a closure cap having an opening in a top wall thereof for receiving the dispenser, the container having a cylindrical neck finish, the closure and the container neck finish having threads for mutual tightening engagement upon cap rotation in a predetermined direction, means for locking the cap on the container when the cap is threaded onto the container, said means comprising a series of ratchet teeth inside the cap and on the outside of the neck finish arranged for mutual engagement, the teeth on the neck finish each having a radially extending trailing face entirely lying in a plane containing the central axis of the neck finish, and the teeth inside the cap each having a trailing face extending radially at an upper end thereof and lying in a plane sloping from said upper end to a lower end thereof toward said predetermined direction at an angle of at least 1° relative to the central axis of the closure for creating a camming action between the closure teeth and the neck finish teeth tending to cam the closure down on the container in response to closure unthreading rotation in a direction opposite said predetermined direction.

2. The closure assembly according to claim 1, wherein the teeth inside the closure are uniformly distributed, contiguous and each have a beveled side face terminating at an adjacent tooth inside the closure.

3. The closure assembly according to claim 1, wherein the teeth inside the cap are located beneath the threads of the cap.

4. The closure assembly according to claim 1, wherein the teeth on the neck finish are located beneath the threads on the container.

* * * * *